US007993217B2

(12) United States Patent
Cameron

(10) Patent No.: US 7,993,217 B2
(45) Date of Patent: Aug. 9, 2011

(54) CURVED GOLF PUTTER

(75) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/783,823

(22) Filed: Apr. 12, 2007

(65) Prior Publication Data

US 2007/0191138 A1 Aug. 16, 2007

Related U.S. Application Data

(63) Continuation-in-part of application No. 11/324,218, filed on Jan. 4, 2006.

(60) Provisional application No. 60/879,525, filed on Jan. 10, 2007.

(51) Int. Cl.
*A63B 53/04* (2006.01)
*A63B 53/06* (2006.01)

(52) U.S. Cl. ..... 473/340

(58) Field of Classification Search ..... 473/324–350
See application file for complete search history.

(56) References Cited

U.S. PATENT DOCUMENTS

| | | | |
|---|---|---|---|
| 1,537,320 | A | 5/1925 | Marsh |
| 1,660,126 | A | 2/1928 | Heeter |
| D89,332 | S | 2/1933 | Bartscg |
| D182,485 | S | 4/1958 | Sprinkel |
| 2,842,369 | A | 7/1958 | East |
| 2,859,972 | A | 11/1958 | Reach |
| 2,934,347 | A | 4/1960 | Sinischalchi |
| D196,736 | S | 10/1963 | De Carlo |
| 3,333,854 | A | 8/1967 | White |
| D217,337 | S | 4/1970 | Zitko |
| 3,680,860 | A | 8/1972 | Elkins, Jr. |
| D228,003 | S | 7/1973 | Warner |
| 3,884,477 | A | 5/1975 | Bianco |
| 3,888,484 | A | 6/1975 | Zitko |
| 3,955,819 | A | 5/1976 | Yokich |
| D245,437 | S | 8/1977 | Thiel |

(Continued)

FOREIGN PATENT DOCUMENTS

| | | | |
|---|---|---|---|
| EP | 0 608 193 | A | 7/1994 |

(Continued)

OTHER PUBLICATIONS

Edwin Watts Golf Spring 2003 Publication.

(Continued)

*Primary Examiner* — Alvin A Hunter
(74) *Attorney, Agent, or Firm* — Murphy & King, P.C.

(57) ABSTRACT

A golf putter with a having a curved body and a high toe design is disclosed and claimed. The putter head includes a face member, which has a heel and a toe, and a body member. The body member is connected to and extends rearward from the face member. At least a portion of the body member is curved toward the heel of the club head. The face member preferably is angled such that the toe has a greater height than the heel. The body member may be similarly angled. The body member extends through the face member and forms at least a portion of a striking face of the club head. The body member may define a hole therethrough, exposing a portion of the face member underneath, which may be used as a club head alignment aid. A variety of body members may interchangeably be connected to a single face member.

21 Claims, 10 Drawing Sheets

U.S. PATENT DOCUMENTS

| | | | | |
|---|---|---|---|---|
| 4,136,877 | A * | 1/1979 | Antonious | 473/254 |
| D251,027 | S | 2/1979 | Cruger | |
| 4,174,839 | A | 11/1979 | Marrs | |
| D264,367 | S | 5/1982 | Gida | |
| 4,795,157 | A | 1/1989 | Bencriscutto | |
| 4,805,922 | A | 2/1989 | Whitfield | |
| 4,861,038 | A | 8/1989 | Fucinato | |
| 4,872,684 | A | 10/1989 | Dippel | |
| 4,913,438 | A | 4/1990 | Anderson | |
| D317,035 | S | 5/1991 | Pelz | |
| D317,490 | S | 6/1991 | Pelz | |
| 5,072,941 | A | 12/1991 | Klein | |
| 5,080,365 | A | 1/1992 | Winchell | |
| D323,688 | S | 2/1992 | Whitney | |
| D324,250 | S | 2/1992 | Magness | |
| D354,535 | S | 1/1995 | Queen | |
| D355,944 | S | 2/1995 | Bendo | |
| 5,470,070 | A | 11/1995 | Bendo | |
| D368,292 | S | 3/1996 | Willoughby | |
| D381,383 | S | 7/1997 | Brett | |
| D385,321 | S | 10/1997 | Quattrochi | |
| 5,692,969 | A | 12/1997 | Schooler | |
| 5,700,207 | A | 12/1997 | Guthrie et al. | |
| 5,746,664 | A | 5/1998 | Reynolds, Jr. | |
| D395,692 | S | 6/1998 | Butler | |
| 5,890,969 | A | 4/1999 | Bechler | |
| D410,055 | S | 5/1999 | Loop | |
| D410,716 | S | 6/1999 | Bendo et al. | |
| 5,984,800 | A | 11/1999 | Uebelhor | |
| D422,328 | S | 4/2000 | Lannoch | |
| 6,045,453 | A | 4/2000 | Jenkins | |
| D448,437 | S | 9/2001 | Colucci | |
| D454,933 | S | 3/2002 | Shenoha | |
| D455,467 | S | 4/2002 | Shenoha | |
| 6,409,610 | B1 | 6/2002 | Ahn et al. | |
| D465,819 | S | 11/2002 | Bussiere | |
| D477,041 | S | 7/2003 | Cameron | |
| D479,291 | S | 9/2003 | Murray | |
| D481,431 | S | 10/2003 | Wightman | |
| D483,824 | S | 12/2003 | Tang et al. | |
| D486,540 | S | 2/2004 | Bettinardi | |
| D486,541 | S | 2/2004 | Bettinardi | |
| D494,236 | S | 8/2004 | Shmoldas et al. | |
| D494,237 | S | 8/2004 | Ware | |
| D497,401 | S | 10/2004 | Zimmerman | |
| D497,402 | S | 10/2004 | Moore | |
| D500,539 | S | 1/2005 | Holloway | |
| D502,518 | S | 3/2005 | Smart | |
| D503,445 | S | 3/2005 | Toroussian | |
| D503,446 | S | 3/2005 | Toroussian | |
| D503,447 | S | 3/2005 | Toroussian | |
| D509,865 | S | 9/2005 | Blancher | |
| 6,958,019 | B2 | 10/2005 | Rohrer | |
| 7,052,409 | B2 * | 5/2006 | Goldsmith | 473/242 |
| D523,915 | S * | 6/2006 | Bergstrom | D21/742 |
| 7,077,757 | B1 | 7/2006 | Payne et al. | |
| 7,407,443 | B2 * | 8/2008 | Franklin et al. | 473/251 |
| 2005/0049076 | A1 | 3/2005 | Schweigert et al. | |
| 2005/0049078 | A1 | 3/2005 | Yamanaka et al. | |
| 2005/0187028 | A1 | 8/2005 | Chang et al. | |
| 2005/0239574 | A1 | 10/2005 | Rohrer et al. | |
| 2006/0052178 | A1 | 3/2006 | Franklin et al. | |
| 2006/0058113 | A1 | 3/2006 | Hasegawa | |
| 2007/0155524 | A1 | 7/2007 | Cameron | |
| 2007/0213141 | A1 * | 9/2007 | Jones | 473/251 |

FOREIGN PATENT DOCUMENTS

| | | | |
|---|---|---|---|
| GB | 2 371 235 | A | 7/2002 |
| GB | 2 405 352 | A | 3/2005 |
| JP | 59-169867 | | 11/1984 |
| JP | 8-510660 | | 11/1996 |
| JP | 10137374 | A | 5/1998 |
| JP | 3053054 | | 7/1998 |
| JP | 2001-302294 | | 9/2001 |
| JP | 2001-305669 | | 10/2001 |
| JP | 2002-85605 | | 3/2002 |
| JP | 2004-264361 | | 9/2004 |
| JP | 2004-321761 | | 11/2004 |
| JP | 2006-263162 | | 10/2006 |

OTHER PUBLICATIONS

Notice of Allowance dated Feb. 17, 2010 of corresponding U.S. Appl. No. 11/324,218.

Japanese Office Action dated Sep. 6, 2010 of corresponding Japanese Patent Application No. 2008-28164.

* cited by examiner

CURVED GOLF PUTTER

CROSS-REFERENCE TO RELATED APPLICATIONS

This is a continuation-in-part of U.S. patent application Ser. No. 11/324,218 filed on Jan. 4, 2006, now pending, which is incorporated herein by reference in its entirety. This application claims the benefit of U.S. Provisional Patent Application No. 60/879,525 filed on Jan. 10, 2007, which is incorporated herein by reference in its entirety.

BACKGROUND OF THE INVENTION

1. Field of the Invention

The present invention relates to a golf club, and, more particularly, the present invention relates to a golf putter having a curved body and a high toe.

2. Description of the Related Art

Golf club heads come in many different forms and makes, such as wood- or metal-type, iron-type (including wedge-type club heads), utility- or hybrid- or specialty-type, and putter-type. Each of these styles has a prescribed function and make-up. The present invention primarily relates to putters, which typically are used to strike a golf ball and impart to it a rolling travel path.

There are many styles of putters, including blades, mallets, heel-toe weighted, and T-line putters. Different types of putters provide different advantages. For example, T-line putters typically have a body member extending rearward from the face. This helps the golfer visualize the intended line of the putt, and may provide improved mechanical attributes. Furthermore, known putters have a generally constant height along the length of the face (sole to top line). However, there are no known putters that provide a curved body member or a high toe.

SUMMARY OF THE INVENTION

The present invention relates to a golf putter with a having a curved body and a high toe design. The putter head includes a face member, which has a heel and a toe, and a body member. The body member is connected to and extends rearward from the face member. At least a portion of the body member is curved toward the heel of the club head. The body member may include a straight portion that is not curved, the straight portion preferably extending immediately rearward of the face member a distance from 0.5 to 3 inches, which transitions into a curved portion. Alternatively, the entirety of the body member extending rearward of the face member is curved. The body member extends through the face member and forms at least a portion of a striking face of the club head.

The curved portion of the body member may be quantified in a variety of manners. One such manner is via the radius of curvature, which preferably is from 0.5 inch to 10 inches. Another such manner is via the angle formed between a first line perpendicular to the face member and a second line tangent to the curved body member portion at a rear-most end of the body member. This body member angle preferably is from 1° to 10°. The curved body portion may be curved uniformly such that there is only one radius of curvature, or the curved body portion may contain a complex curve pattern such that there are multiple radii of curvature.

The face member preferably is angled such that the toe has a greater height than the heel. The angle formed by the top surface of the face member and a horizontal plane at the normal address position preferably is from 1° to 10°. The body member may preferably be angled similarly. These angles are preferably within one-half degree of each other, within one-half degree of the face member angle, and within one-half degree of the club head loft angle.

The body member preferably is tapered at an angle within one-half degree of the face member angle. This tapering may be along the top surface such that the body member has a greater height towards the toe than it does towards the heel, at a lower, rear portion of the body member, or both.

The body member may define a hole therethrough, exposing a portion of the face member to be viewable from above. An alignment aid may be positioned on the face member such that it is viewable through the body member hole. This alignment aid may function independently, such as color coding that is viewable when the golf club is in a correct use position or, alternatively, that is viewable when the golf club is not in a correct use position. The alignment device may also function in conjunction with other portions of the club head, such as being a line segment or arc that is in alignment with a second line segment or arc, positioned on the body member, when the club is in a correct use position.

The golf club contains a shaft, which may be connected to the club head via a hosel. The hosel may be angled relative the top surface of the face member such that it is angled relative the face member within one-half degree of the loft angle, the body member angle, and/or the face member angle.

The face member preferably is formed of a stainless steel, and the body member preferably is formed of aluminum or an aluminum alloy. To achieve desirable playing characteristics, the club head may contain weight modifying attributes. For example, the face member may contain weight-reducing recesses therein, and the body member may contain weight-reducing holes passing at least partially therethrough. Weight members may be included in the face member, the body member, or both. Such cavities, holes, and weight members allow the club head designer to achieve the desired overall club head weight, as well as desired moments of inertia and center of gravity locations.

DESCRIPTION OF THE DRAWINGS

The present invention is described with reference to the accompanying drawings, in which like reference characters reference like elements, and wherein:

FIG. 3 shows a bottom perspective view of the golf club head of FIG. 1;

FIG. 4 shows an exploded view of the golf club head of FIG. 3;

DETAILED DESCRIPTION OF THE INVENTION

Other than in the operating examples, or unless otherwise expressly specified, all of the numerical ranges, amounts, values, and percentages may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
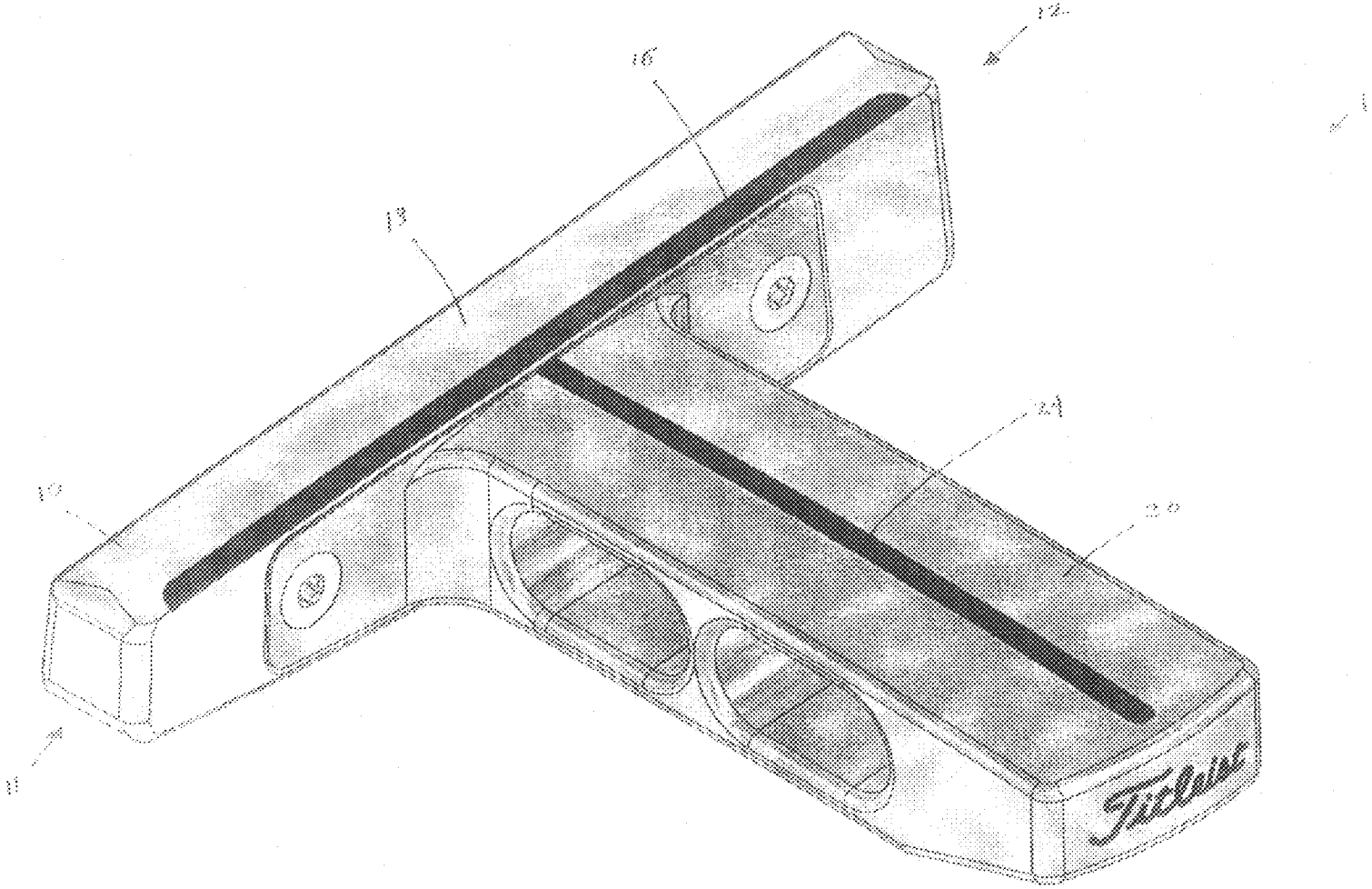
FIG. 1 shows a top perspective view of a golf club head of the present invention.
Figure 2:
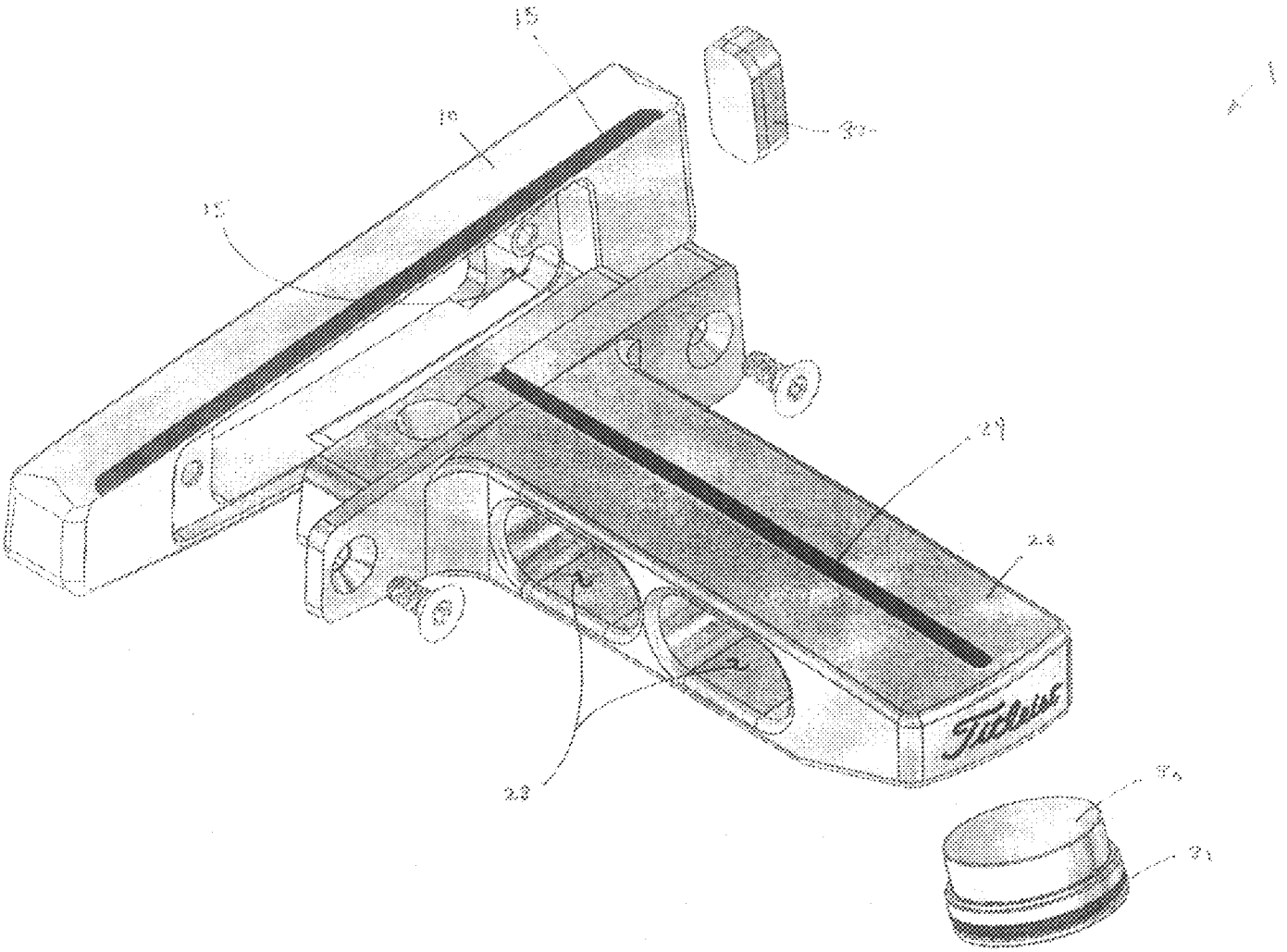
FIG. 2 shows an exploded view of the golf club head of FIG. 1.
Figure 5:
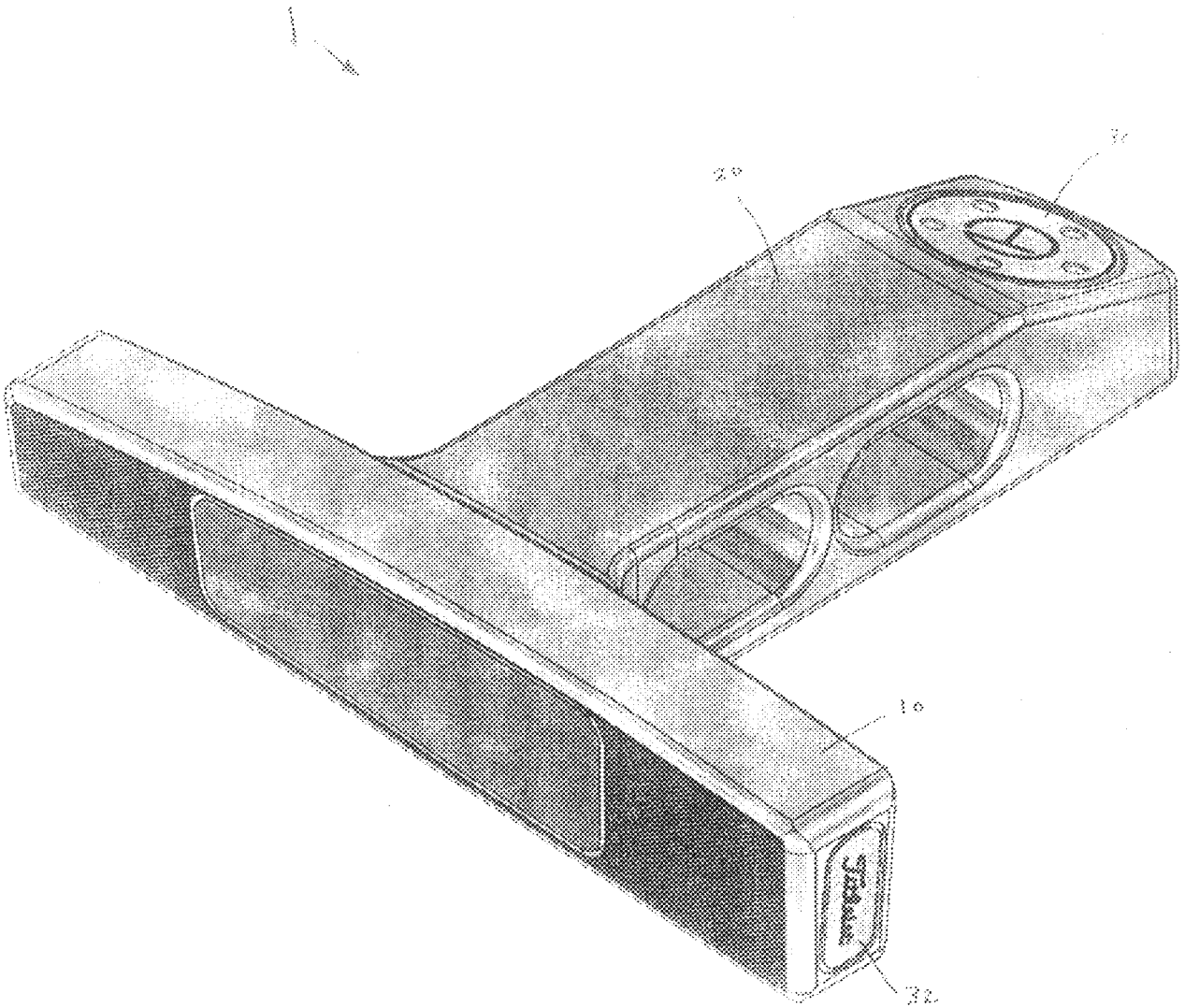
FIG. 5 shows a top view of the golf club head of FIG. 1.
Figure 11:
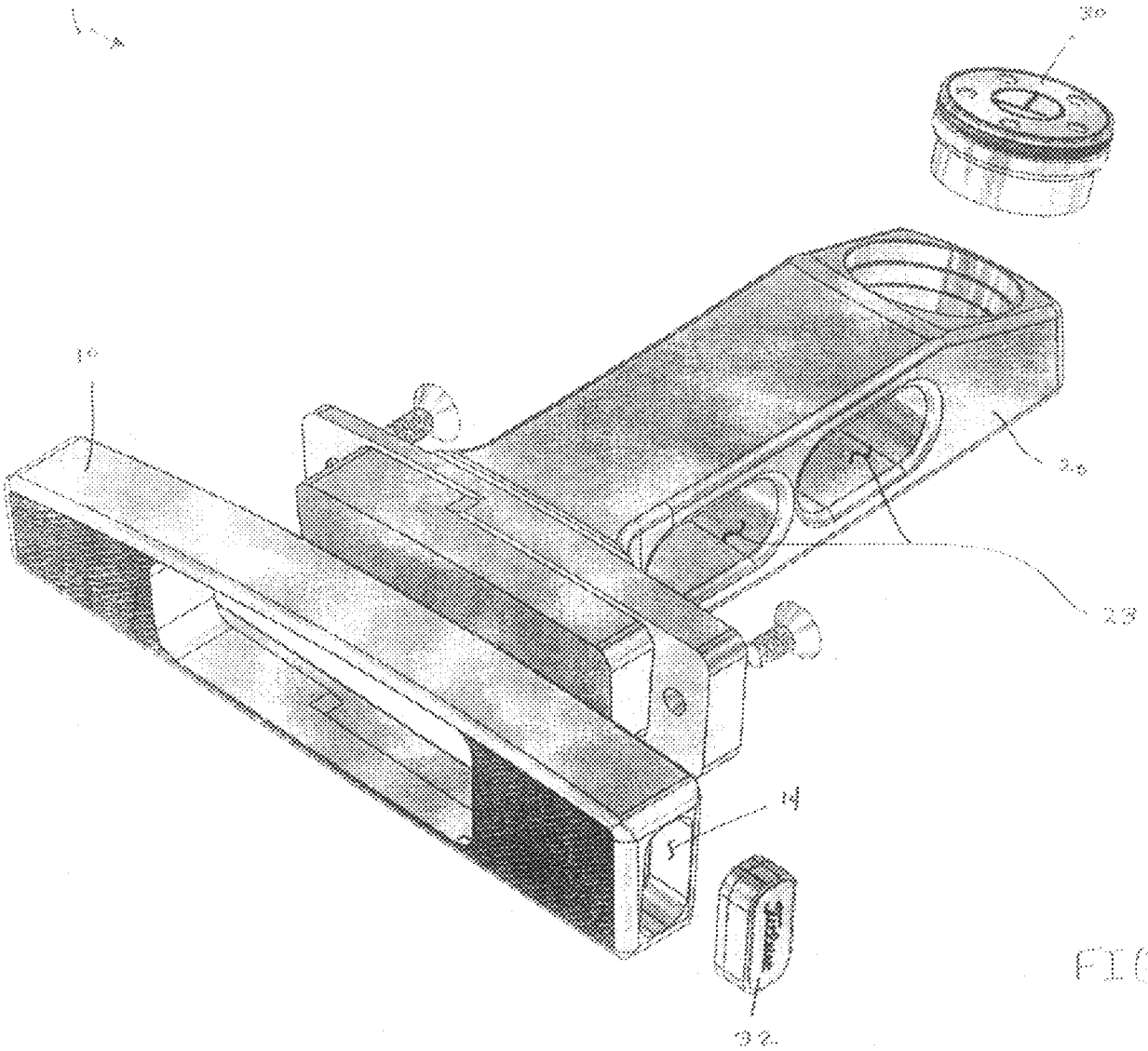
Figure 5:
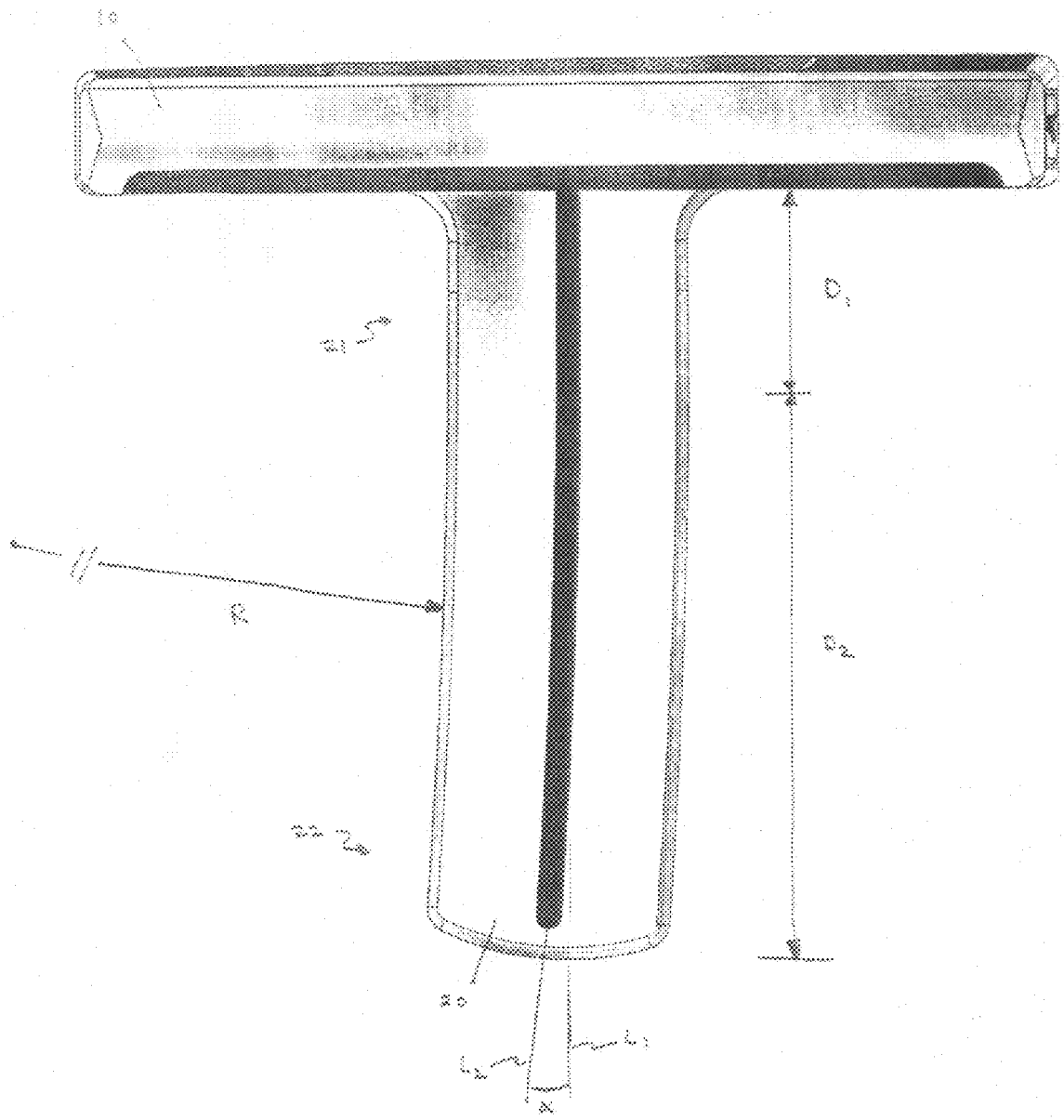

FIGS. 1 and 3 show top and bottom perspective views, respectively, of a golf club head 1 of the present invention, and FIGS. 2 and 4 show exploded views thereof, respectively. The club head 1 includes two main components: a face member 10 and a body member 20. The face member 10 and body member 20 are connected such that the body member 20 extends rearward from the face member 10. As seen in FIG. 5, the body member 20 is curved toward the heel 11 of the club head 1. This provides an alignment tool for the golfer to use the proper swing path. The putting stroke, like other golf strokes, should pivot about the golfer's body. The arc of the swing is dictated by the club lie angle (the angle between the shaft and the club head); the flatter the lie, the greater the swing path arc. The curved nature of the body member 20 encourages the golfer to use the correct swing path.

The curved body member 20 may be quantified in a variety of manners. For example, the body member may have a radius of curvature R, which may be from 0.5 inch to 10 inches, with 3 to 7 inches being more preferred. Alternatively, or additionally, the body member curvature can be described by the angle $\alpha$ formed between a first line $L_1$, which is perpendicular to the face member 10, and a second line $L_2$, which is tangent to the curved body member 20. The lines $L_1$, $L_2$ may be positioned in a variety of locations. In the illustrated embodiment, the first line $L_1$ passes through a center point of the body member 20 at the rear-most portion of its junction with the face member 10, and the second line $L_2$ is tangent to the body member 10 at a rear-most end of the body member 20. The body member angle $\alpha$ formed by the lines $L_1$, $L_2$ may be from 1° to 10°, with 3° to 7° being more preferred. This amount of curvature encourages the golfer to putt along a proper swing path while maintaining a pleasing and beneficial aesthetic appearance to the club head 1. Where one of these exemplary manners of quantifying the body member curvature is used herein, the skilled artisan will recognize that the other exemplary manner, as well as additional manners, may equally be used.

At least a portion of the body member 20 is curved toward the heel 11. That is, the body member 20 may contain a straight portion 21 in addition to a curved portion 22. The straight portion 21, which is not curved, preferably extends immediately rearward of the face member 10. At some point along the body member 20 rearward of the face member 10, the straight portion 21 transitions into the curved portion 22, which exhibits the traits discussed above. Preferably, the remainder of the body member 20 is curved. That is, preferably the entirety of the body member 20 extending rearward of the face member 10 is formed by the union of the straight portion 21 and the curved portion 22. The distance $D_1$ that the straight portion 21 extends rearward from the face member 10 preferably may be from 0.5 to 3 inches. The distance $D_2$ that the curved portion 22 extends beyond the straight portion 21 is a function of the overall length of the body member 20, and preferably may be from 2 to 4.5 inches. The overall length of the body member 20 extending rearward from the face member 10 may preferably be from 2 to 5 inches. It should be noted that a skilled golf club designer, in keeping with the benefits disclosed herein, may choose alternate dimensions than those presented above.

Alternatively, all of the body member 20 extending rearward from the face member 10 may be curved. In other words, the distance $D_1$ that the straight portion 21 extends rearward from the face member 10 may be from 0 to 3 inches. The curvature of the body member 20, whether it be all or only a portion of the overall body member length, preferably has a constant curvature. That is, the curved portion 22 of the body member 20, which may extend along the entire length of the body member 20 rearward from the face member 10, has a constant radius of curvature R. This helps present an aesthetically pleasing, flowing look to the club head 1. Alternate embodiments, however, may include a body member 20 having multiple radii of curvature along the curved body member portion 22. As one example, a first region of the curved portion 22 nearest the face member 10 may have a greater radius of curvature than a second region of the curved portion 22 further away from the face member 10.

Figure 7:
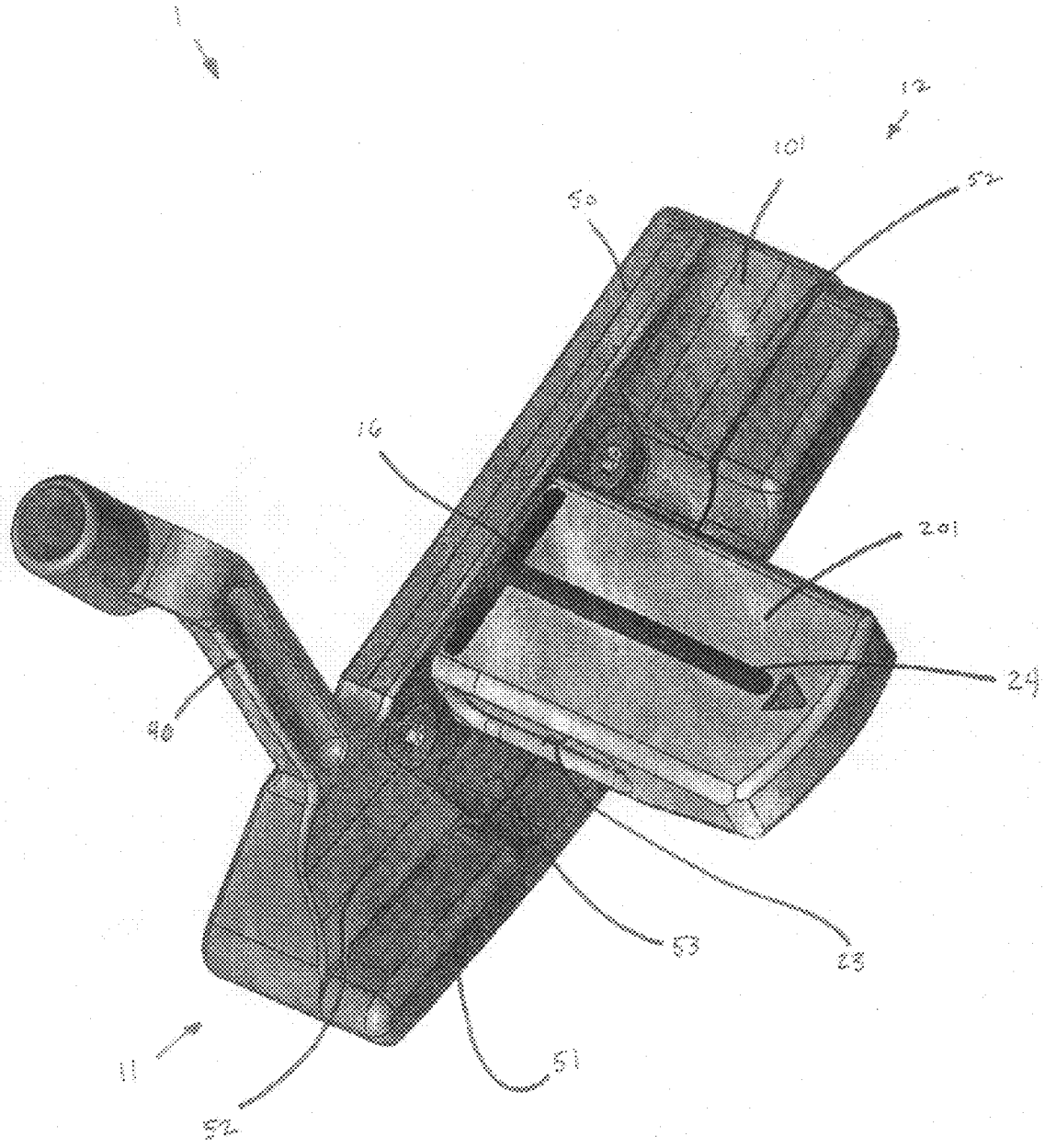
FIG. 7 shows another embodiment of a club head of the present invention.

FIG. 7 shows another embodiment of a club head 1 of the present invention. In this embodiment, the face member 101 has a more traditional appearance. The face member 101 has a relatively thin top line 50, and a relatively thicker sole 51 as compared to the top line 50. Furthermore, face member 101 has flanges 52 at heel and toe portions, which define a cavity 53 in a central region thereof. Optionally, one or more weight members may be included, such as at or in heel and toe portions of the sole. This design biases the club head weight on sole sides of the heel 11 and toe 12, and provides a desired heel-toe, front-back, and top-bottom weighting, resulting in a balanced, stable golf club. The body member 201 is connected to the face member 101 and extends rearward therefrom, as discussed above. Preferably, the body member 201 is curved for the beneficial reasons as discussed above. In the illustrated embodiment of FIG. 7, the body member 201 does not extend as far rearward as the previously discussed body member 20. This may be more beneficial to some golfers. Preferably, the body member 201 extends 1 to 4 inches, and more preferably 1 to 3 inches, rearward from the rear surface of the face member 101 opposite the striking face of the club head 1. The body member 201 may include one or more weight removing bores or holes 23 as desired.

The body member 201 may be connected to the face member 101 in a variety of manners. As shown in the illustrated embodiment of FIG. 7, mechanical fasteners may be used as the coupling means. Adhesives, epoxies, etc. may also be used, alone or in conjunction with the mechanical fasteners. This may be desired, for example, when the golfer intends to use the body member 201 during a round of golf. It is possible that the golfer may desire to use the swing path alignment tool (that is, body member 201) only during practice. In this case, the body member 201 may be coupled to the face member 101 such that it may be easily attached and removed. Again, mechanical fasteners, adhesives, epoxies, etc. may be used, but if an adhesive or epoxy is chosen it should not be of such a strength that it makes attachment and detachment of the body member 201 difficult. It should be noted that this body member 201 may be connected to existent putters, providing the benefits discussed herein to be realized with known putters.

Figure 6:
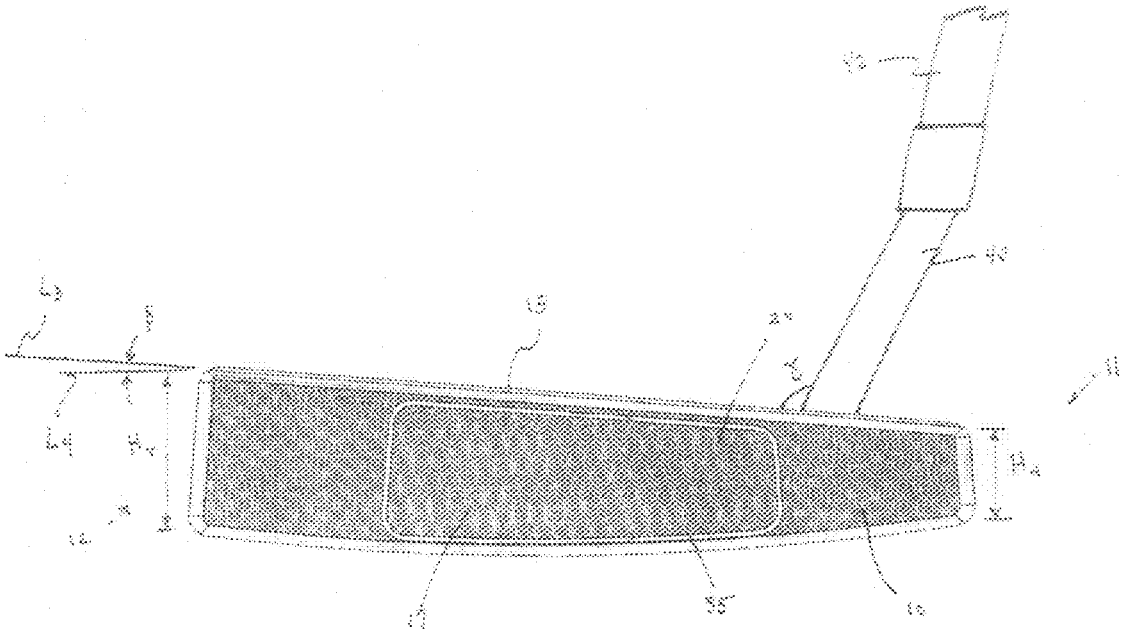
FIG. 6 shows a front view of the golf club head of FIG. 1.

While known putters have a generally constant height along the length of the face (sole to top line), most iron-type golf clubs have an angled top line such that the toe height is greater than the heel height. This disparity may likely cause a golfer to raise the toe of the putter to achieve a similar look at address with the putter as with the irons. This toe elevation, however, causes the putt line of the putt to actually be aimed left of the target (for a right-handed golfer; the putt line would be aimed right of the target for a left-handed golfer). This phenomenon is a result of the putter's loft angle. To alleviate this misalignment, one embodiment of the present invention provides a putter-type golf club head 1 with a face member 10 having a top surface 13 that is angled. As shown in FIG. 6, the face member 10 includes a top or upper surface 13 that is angled such that the height $H_T$ at the toe 12 is greater than the height $H_H$ at the heel 11. Because the angled nature of the face member 10 causes the putter toe 12 to have a similar appearance to an iron-type golf club head, the golfer is less likely to raise the toe at address. Thus, the resulting putt is more true and more likely to achieve the desired result. The overall length of the face member 10, in a heel-to-toe direction may preferably be from 2 to 5 inches.

As shown in FIG. 6, line $L_3$ shows an extension of the surface 13 and line $L_4$ represents a horizontal plane (with the club head 1 being in the address position). These lines $L_3$, $L_4$ form a face member angle β, which may be from 1° to 10°, with 3° to 7° being more preferred. In one embodiment, the face member angle β is matched to the putter head loft angle such that it is within (plus/minus) one-half degree of the loft angle (that is, the angle formed between the striking face of the club head and a vertical plane at address). The body member angle α and face member angle β may be matched such that they are within one-half degree of each other, and, optionally, within one-half degree of the loft angle. This angle matching results in a club head having a flowing, aesthetically pleasing shape and appearance.

As shown most clearly in FIG. 6, the body member 20 may also be angled or tapered similarly to the face member 10. That is, the top surface of the body member 20 may be angled such that the toe side has a greater height than the heel side. Preferably, the body member 20 is angled at the same angle as the face member 10 (face member angle β). A lower, rear portion of the body member 20 may also be tapered. For example, and as shown in the drawing figures, the lower, rear portion of the body member 20 may be tapered or angled upward towards the top surface of the body member in a direction away from the face member 10 (that is, the horizontal component of the taper angle preferably is substantially perpendicular to the face member 10). Each of these body member taper angles preferably is from 1° to 10°, and may be within one-half degree of the loft angle, the body member angle α, and/or the face member angle β.

A preferred material for the face member 10 includes stainless steel, such as 8802 stainless steel, and preferred materials for the body member 20 include aluminum or aluminum alloy. To achieve desired moment of inertia (MOI) characteristics, weight members may included with the body member and/or 20 face member 10. For example, a weight member 30 may be positioned in a rear portion of the body member 20. One preferred location is the lower side of the face member 20 in the tapered area mentioned above. The weight member 30 may have a mass from 5 to 30 grams. Preferably, a plurality of weight members 30 having varying masses are provided and a specific weight member 30 chosen therefrom depending on the particular golfer's needs. For example, weight members 30 having masses differing by 5 grams or 10 grams may be provided, and the appropriate mass for a particular golfer selected by the club designer or club fitter. In this manner, the club head 1 (and resulting golf club) can be tailored to a golfer's individual needs. The particular weight member 30 used is attached in known manner, and preferably such that it is not readily adjustable during use. A gasket or o-ring 31 may be provided with the weight member 30 to ensure a solid feel to the club head 1. Similarly, one or more weight members 32 may be included with the face member 10.

More material is inherently present in the toe 12 due to the tapered nature of the face member 10. For the same reason, the club head 1 center of gravity is biased towards the toe 12, which may provide golfers with a similar feel to an iron-type club and further encourage the proper swing plane and path. As a means of controlling the overall weight/mass of the club head 1, weight adjustments may be incorporated into the design of the club head. For example, material may be removed from the toe 12, forming a weight-reducing recess 14. The weight member 32 is positioned within at least a portion of the recess 14. To further achieve these weight constraints, the weight member 32 may take the form of a low-mass insert rather than a weight. In this case, the mass of the face member 10 itself provides the desired MOI. Another exemplary weight reduction means includes removal of material from the inner surfaces of the face member 10 at the junction with the body member 20. Thus, a weight reducing recess 15 is seen in FIG. 2. It should be noted that enough material is provided in the face member 10 to ensure a proper connection between the face member 10 and the body member 20.

To further ensure the appropriate overall club head weight is achieved, weight reducing holes 23 may be provided in the body member 20. These holes 23 may pass entirely through the body member 20, or only partly through the body member 20 such that they form cavities. In the latter case, a pair or pairs of mirrored cavities are provided on either side of the body member 20. Two such holes (or cavity pairs) 23 are shown in the illustrated embodiments. More or fewer holes 23 may also be used. The number of holes 23 may be a function of the putter type. For example, two such holes 23 may be provided with a standard putter, one such hole 23 for a belly putter, and no such holes 23 for a long putter. The weight members 30, 32 may also be chosen based at least in part on the putter type.

Figure 10:
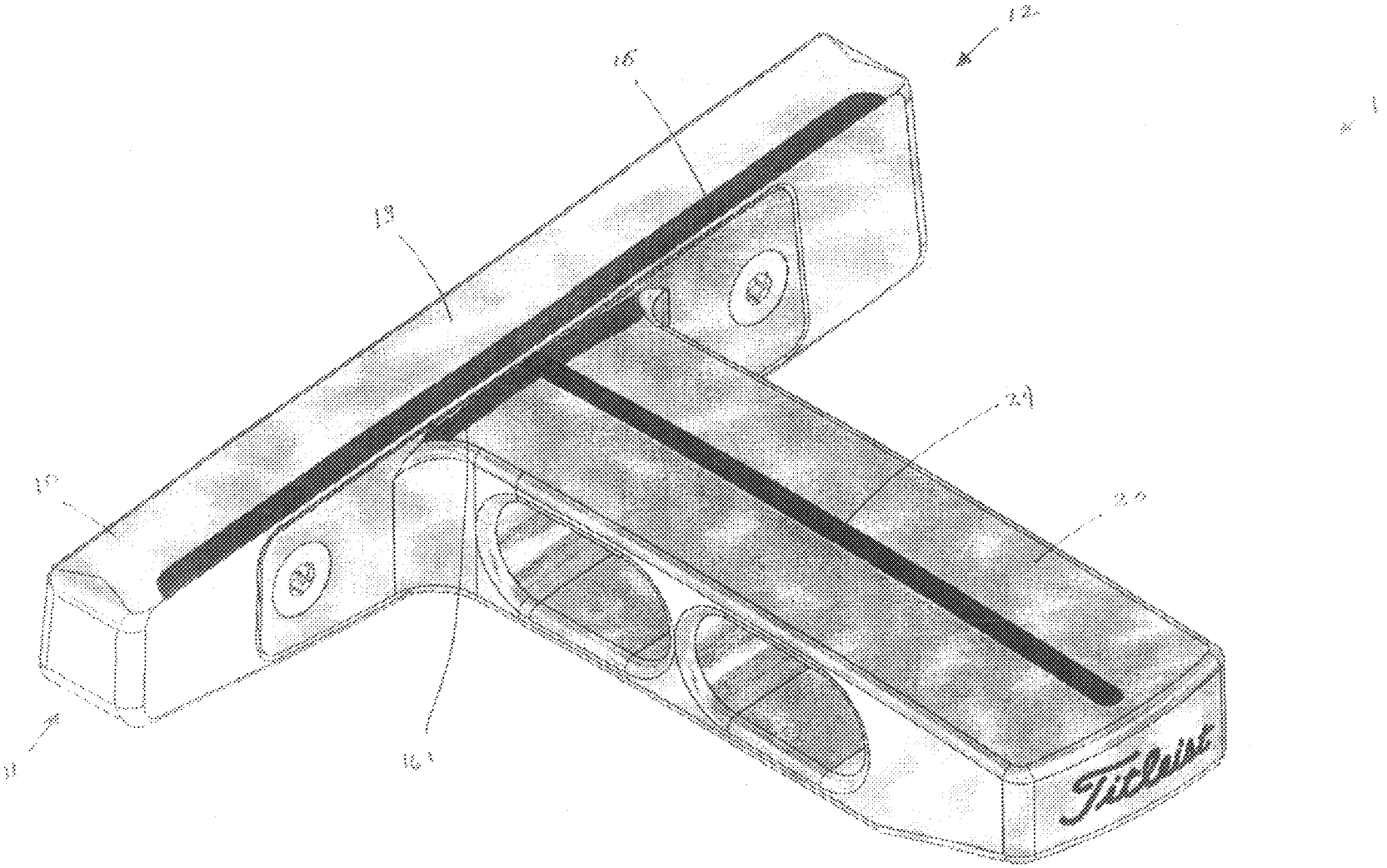
FIG. 10 shows a top perspective view of a golf club head of the present invention.

The club head 1 may include indicia to further encourage a proper swing and desired resulting golf shot. For example, a sight or aiming line 16 may be provided in or along the top surface 13. In the illustrated embodiments, aiming line 16 extends in the heel-to-toe direction and is substantially perpendicular to the intended path of the putt. This helps the golfer visualize and achieve the desired result. As an additional example, a swing path line 24 may be provided in or along the top surface of the body member 20. The swing path line 24, which helps the golfer visualize and achieve the proper swing plane and path, preferably is positioned in the center of the body member 20. While these indicia 16, 24 are illustrated in the figures as thickened, dark lines, the skilled artisan will realize that the indicia 16, 24 may take a variety of other forms. For example, the indicia may be thinner lines, different colors, dots instead of lines, etc. As shown in FIG. 10, an aiming line 16' may be positioned atop the body member 20 adjacent and parallel to the longitudinal axis of the face member 10. This heel-to-toe aligned aiming line 16' may be used in conjunction with, or preferably instead of, the substantially parallel aiming line 16 atop the face member 10.

Figure 8:
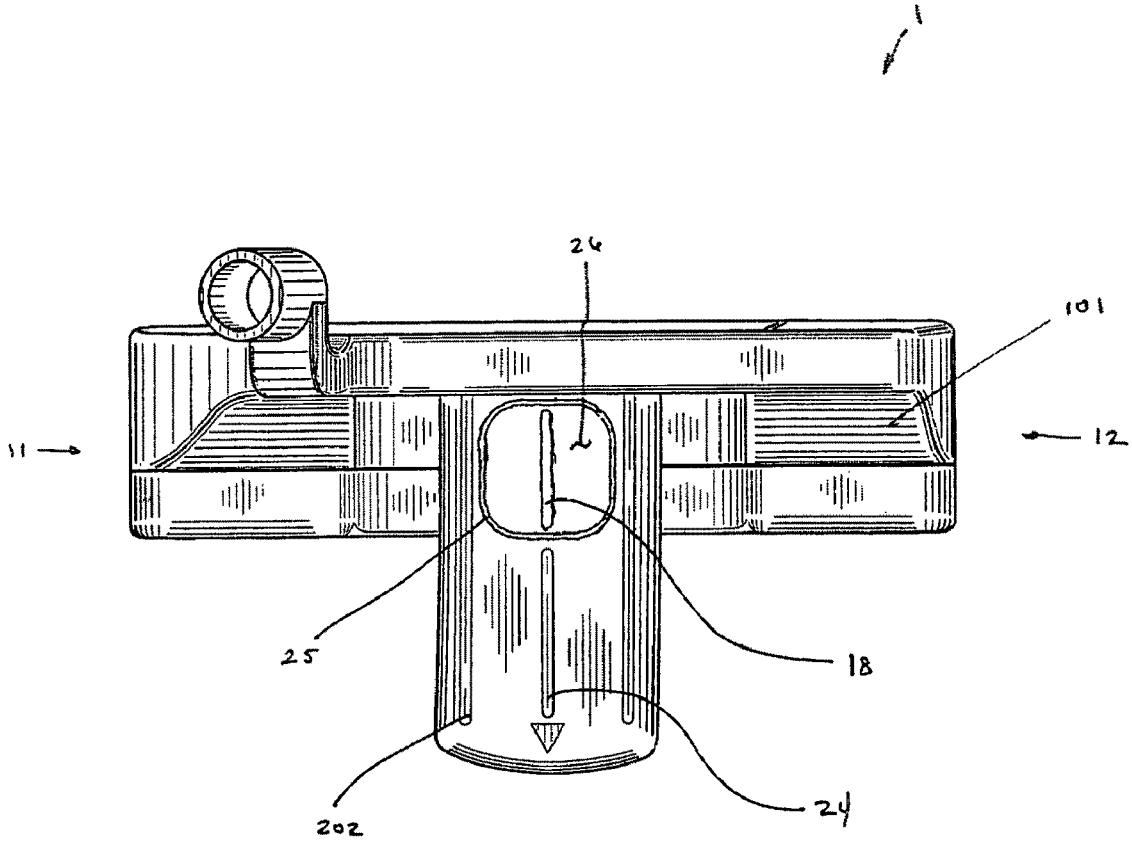
FIG. 8 shows another embodiment of a club head of the present invention.

FIG. 8 shows another embodiment of a club head 1 of the present invention, the club head 1 including a face member 101 and a body member 202. While this embodiment is illustrated as being similar to that of FIG. 7, it could also be of the type illustrated in FIG. 1. The body member 202 includes a wall 25 that defines a hole 26 extending through the body member 202. If the body member 202 is positioned adjacent a substantially vertical rear surface of the face member 101 opposite the striking face and atop a substantially horizontal surface of the face member 101, this substantially horizontal surface will be visible to the golfer through the hole 26. As used here, "substantially" vertical and "substantially" horizontal are used to differentiate the relative surfaces of the face member 101. The surfaces do not have to actually be precisely vertical or precisely horizontal, respectively. In addition to removing weight from the forward portion of the club head, the hole 26 allows a portion of the face member 101 to be visible from above. This beneficially allows the indicia 18 located on the face member 101 to be visible to the golfer through the hole 26. In the illustrated embodiment of FIG. 8, this indicia 18 is shown as being an extension of the swing path line 24. Due to the relative height difference between the indicia 18, 24, this embodiment includes a secondary alignment aid. In order for the indicia 18, 24 to appear as a continuous line, the club head must be retained in the proper position. If the toe 12 is too high or too low, the indicia 18, 24 will appear as a broken or jogged line rather than a continuous line. In a high toe position, the face member indicium 18 will appear to be closer to the toe 12 than the body member indicium 24. Similarly, in a low toe position, the face member indicium 18 will appear to be closer to the heel 11 than the body member indicium 24. Thus, through the inclusion of the hole 26 and the indicia 18, the present invention may include a lie angle alignment aid, further allowing the golfer to achieve beneficial results. In this sense, "lie angle" may refer to the angle between the shaft and the club head or it may refer to the angular position of the golf club in a vertical plane passing through the club head longitudinal axis. Preferably, the first and second indicia 18, 24 are vertically offset by 0.25 to 1.5 inches. The face member indicium 18 should be positioned on the face member 101 such that it will create a continuous line with the body member indicium 24 when the club head 1 is in a square orientation. It should be noted that this position may vary among golfers, and the proper position for the face member indicium 18 may not be aligned with the center of the hole 26. This arrangement may also function as an aid for achieving the proper rotational position about a vertical axis to prevent the toe 12 from being yawed forward or rearward.

Instead of being in the form of a line, the face member indicium 18 may be provided in a variety of other shapes or forms. For example, other shapes such as triangles and circles may be used. Furthermore, the face member indicium 18 may take the form of a color. For example, at least a portion of the face member 101 corresponding to the hole 26 may be provided in a color distinguishable from the other portions of the club head, such as red. By positioning indicium 18 as taught above, the golfer will know that seeing the red color means the club head 1 is aligned properly. Conversely, the indicium 18 could be positioned such that seeing the red color means that the club head 1 is not aligned properly and adjustments must be made.

Figure 9:
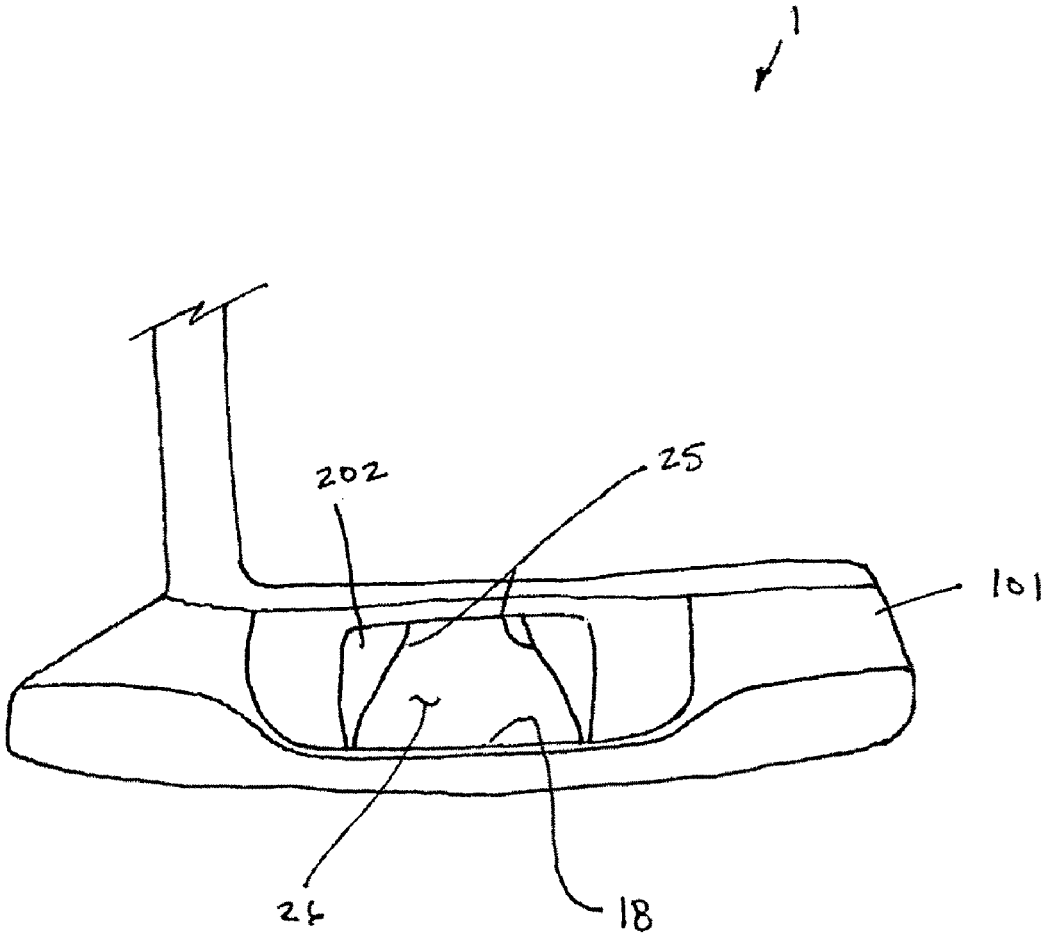
FIG. 9 shows a partial cross-section of a golf club head of the present invention.

In the embodiment illustrated in FIG. 9, which shows a partial cross-section of a golf club head 1 of the present invention, the wall 25 is sloped inward from top to bottom. This may be desired to optimize the alignment benefits of the club head 1. Furthermore, inclusion of horizontal holes 23 in the body member 202 may additionally allow more light into the body member hole 26, making the indicia 18 easier to see.

The body member 20 may extend through the face member 10 to form at least a portion of the club head striking face or surface 17. As shown, for example, in FIG. 6, the body member 20 is coupled to the face member 10 such that its forward-most portion is flush with the forward-most portion of the face member 10, cooperatively forming the striking face 17. This helps ensure a solid feel to the putter and a desirable resulting putt. A layer of 35 vibration damping material may be positioned between the face member 10 and the body member 20 in the region of the striking face 17. This layer 35 may take the form of an adhesive or epoxy that is used to couple the face member 10 and the body member 20. Alternatively, the layer 35 may be an independent component, such as elastomer, polyurethane, or the like, which is coupled to both the face member 10 and the body member 20. In some embodiments, such as that shown in FIG. 7, the body member may not extend through the face member to form a portion of the striking face 17. This may be desirable, for example, when the body member is added to an existing golf club head or when the golfer wishes to have the option of using the curvilinear swing aid only during practice.

A hosel 40 and shaft 42 may be attached to the club head, to the face member 10 or the body member 20, in known manner. Such hosel 40 and/or shaft 42 may be attached to the club head 1 in any manner, such as straight, angled, and offset. See U.S. Pat. No. 6,334,818 and U.S. patent application Ser. No. 10/946,394, the disclosures of which are incorporated herein. If an angled hosel 40 is used, it preferably forms an angle $\gamma$ relative the top surface 13 that is within one-half degree of the loft angle, the body member angle $\alpha$, and/or the face member angle $\beta$. The angle of the shaft, which is coupled to the hosel, may be altered as needed. The shaft and/or hosel may be a bore-through design or, alternatively, may not extend completely through to the club head sole.

The club head components are formed in known manner, such as by milling. Other manufacturing methods may also be used. The components are assembled in known manner, such as by mechanical connections, adhesives, or a combination thereof.

As discussed above, the body member and the face member of the present invention may be coupled together using varying techniques, some of which being non-permanent. Use of such non-permanent coupling means, such as mechanical fasteners, allows a variety of body members to be connected to the same face member 10. For example, a group of body members including the body member 20 of FIGS. 1-6, the body member 201 of FIG. 7, the body member 202 of FIGS. 8-9, and the body member 20 of FIG. 10 could all be interchangeably coupled to the same face member 10. This interchangeability allows the golfer a great amount of flexibility in selecting a golf putter design for a specific purpose. For example, the golfer may want to practice using the body member 20 of FIGS. 1-6, but use the body member 201 of FIG. 7 when playing a round of golf. The golfer may also want to remove the extension altogether and use a face insert with heavier weights, such as disclosed in U.S. Pat. No. 6,231,458, which is incorporated herein by reference. This interchangeability also enhances the golf pro's ability to observe and assess a golfer under varying equipment configurations during instruction. Moreover, this interchangeability also reduces manufacturing time and expense by reducing the number of different parts required for a plurality of golf club heads.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A golf club head, comprising:

a face member defining a striking face and comprising:

a rear surface opposite the striking face comprising a substantially vertical portion and a substantially horizontal portion, wherein the substantially horizontal portion comprises a first alignment aid;

a heel; and a toe; and a body member coupled to the substantially vertical portion of the rear surface, wherein the body member comprises a straight portion extending rearward from the rear surface and a curved portion curved only toward the heel and extending rearward from the straight portion, and wherein the straight portion of the body member further comprises a hole exposing the substantially horizontal portion, and wherein the body member comprises a second alignment aid.

2. The golf club head of claim 1, wherein said body member extends from 1 to 4 inches from said rear surface.

3. The golf club head of claim 1, wherein said curved portion of said body member has a radius of curvature from 0.5 inch to 10 inches.

4. The golf club head of claim 3, wherein said radius of curvature is constant through the entire curved portion.

5. The golf club head of claim 1, wherein a first line perpendicular to said face member and a second line tangent to said curved body member portion at a rear-most end of said body member form an angle from 1° to 10°.

6. The golf club head of claim 5, wherein the club head contains a loft angle that is within one-half degree of said angle.

7. The golf club head of claim 1, wherein the second alignment aid is curved to the same degree as the curved portion of the body member.

8. A golf club head, comprising:

a face member defining a striking face and having a first, substantially vertical rear surface opposite said striking face, a second, substantially horizontal rear surface, a heel, and a toe; and a body member coupled to said first rear surface and extending rearward away from said striking face, said body member defining a hole therethrough, exposing a portion of said substantially horizontal surface;

wherein said face member includes an alignment aid on said substantially horizontal surface portion, and wherein at least a portion of said body member is curved toward said heel, and wherein said curved portion of said body member has a radius of curvature from 0.5 inch to 10 inches.

9. The golf club head of claim 8, wherein said alignment aid is in the form of a first line, said body member including a second line on an upper surface thereof, said first and second lines being in alignment when the golf club head is properly aligned with the golf ball.

10. The golf club head of claim 9, wherein said first and second lines are vertically offset by 0.25 to 1.5 inches.

11. The golf club head of claim 9, wherein said first and second lines are arcs.

12. The golf club head of claim 8, wherein said alignment aid is in the form of a colored surface.

13. The golf club head of claim 12, wherein said colored surface is visible to a user when the golf club head is properly aligned with the golf ball.

14. The golf club head of claim 12, wherein said colored surface is not visible to a user when the golf club head is properly aligned with the golf ball.

15. The golf club head of claim 8, wherein a first line perpendicular to said face member and a second line tangent to said curved body member portion at a rear-most end of said body member form an angle from 1° to 10°.

16. A golf club head, comprising:

a face member defining a striking face and having a heel and a toe, wherein the face member has a top surface, and wherein the top surface has a first height at the toe and a second height less than the first height at the heel; and a body member coupled to the face member, wherein the body member defines a hole therethrough, exposing a substantially horizontal portion of the face member, wherein the body member is curved only toward the heel, and wherein the substantially horizontal portion of the face member comprises a first alignment aid.

17. The golf club head of claim 16, wherein the body member has a top surface that is angled downward from a toe side of the golf club head to a heel side of the golf club head.

18. The golf club head of claim 16, wherein the body member comprises a second alignment aid.

19. The golf club head of claim 18, wherein the first alignment aid and the second alignment aid are vertically offset by 0.25 inches to 1.5 inches.

20. The golf club head of claim 18, wherein the first and second alignment aids are lines.

21. The golf club head of claim 20, wherein the first alignment aid creates a continuous line with the second alignment aid when the golf club head is in a square orientation.

* * * * *